US006493946B1

(12) United States Patent
Carrillo

(10) Patent No.: US 6,493,946 B1
(45) Date of Patent: Dec. 17, 2002

(54) KNIFE GUARD

(76) Inventor: Carl L. Carrillo, P.O. Box 10909, Hilo, HI (US) 96721

( * ) Notice: Subject to any disclaimer, the term of this patent is extended or adjusted under 35 U.S.C. 154(b) by 42 days.

(21) Appl. No.: 09/851,982

(22) Filed: May 10, 2001

Related U.S. Application Data

(60) Provisional application No. 60/207,357, filed on May 26, 2000.

(51) Int. Cl.[7] ..... B26B 29/02

(52) U.S. Cl. ..... 30/295; 30/296.1

(58) Field of Search ..... 30/295, 296.1, 30/123, 138, 298.4, 151, 142, 143, 286; 76/82, 88; D7/401.2

(56) References Cited

U.S. PATENT DOCUMENTS

| | | | | | |
|---|---|---|---|---|---|
| 230,393 | A | | 7/1880 | Barker et al. | |
| 319,091 | A | | 6/1885 | Harrington | |
| 492,409 | A | * | 2/1893 | May | 30/295 |
| 1,222,366 | A | * | 4/1917 | Curry | 30/286 |
| 1,750,577 | A | * | 3/1930 | Bracht | 30/295 |
| 2,561,289 | A | * | 7/1951 | Paris | 30/296.1 |
| 2,590,709 | A | * | 3/1952 | Kahn | 30/295 |
| 2,650,424 | A | * | 9/1953 | Kalmon | 30/295 |
| D255,974 | S | * | 7/1980 | Jacoby | D7/401.2 |
| 4,959,905 | A | | 10/1990 | Ghislain | |
| 5,113,587 | A | | 5/1992 | Loomis | |
| 5,679,068 | A | * | 10/1997 | Byers et al. | 76/86 |
| 6,381,855 | B1 | * | 5/2002 | Lin | 30/295 |
| 6,434,838 | B1 | * | 8/2002 | Mai | 30/151 |

* cited by examiner

*Primary Examiner*—Hwei-Siu Payer
(74) *Attorney, Agent, or Firm*—Patent & Trademark Services; Joseph H. McGlynn

(57) ABSTRACT

An accessory for knives which will protect the blade, when the knife is not in use, sharpen the blade when necessary, and provide greater cutting power to the knife blade.

8 Claims, 1 Drawing Sheet

KNIFE GUARD

Applicant claims priority of Provisional Ser. No. 60/207357, filed May 26, 2000.

BACKGROUND OF THE INVENTION

This invention relates, in general, to kitchen accessories, and, in particular, to an accessory for a knife.

DESCRIPTION OF THE PRIOR ART

In the prior art various types of kitchen knives have been proposed. For example, U.S. Pat. No. 4,959,905 to Ghislain discloses a knife accessory having a slot for receiving the sharp edge of a knife.

U.S. Pat. No. 5,113,587 to Loomis discloses a knife with a handle which is mounted over the knife to help cutting firm articles.

U.S. Pat. No. 230,393 to Barker et al discloses a removable handle for a knife which is mounted over the knife to help cutting firm articles.

U.S. Pat. No. 319,091 to Harrington discloses an additional handle for a knife which surrounds the knife blade.

While the prior art inventions work for their intended purposes, all of the prior art patents have drawbacks. Primarily, none of the prior art patents take into consideration all of the difficulties associated with knives such as protecting the blade edge, sharpening the blade and increasing the cutting power of the blade. While the prior art patents provide for some of these functions, none of the patents take all of these criteria into consideration and provide a single accessory which will provide a useful and convenient accessory for knives.

SUMMARY OF THE INVENTION

The present invention is directed to an accessory for knives which will protect the blade, when the knife is not in use, sharpen the blade when necessary, and provide greater cutting power to the knife blade.

It is an object of the present invention to provide a new and improved accessory for knives.

It is an object of the present invention to provide a new and improved accessory for knives which is conveniently and readily accessible for use.

It is an object of the present invention to provide a new and improved accessory for knives which will protect the blade, sharpen the blade and provide greater cutting power in a single accessory.

These and other objects and advantages of the present invention will be fully apparent from the following description, when taken in connection with the annexed drawings.

DESCRIPTION OF THE PREFERRED EMBODIMENT

Figure 1:
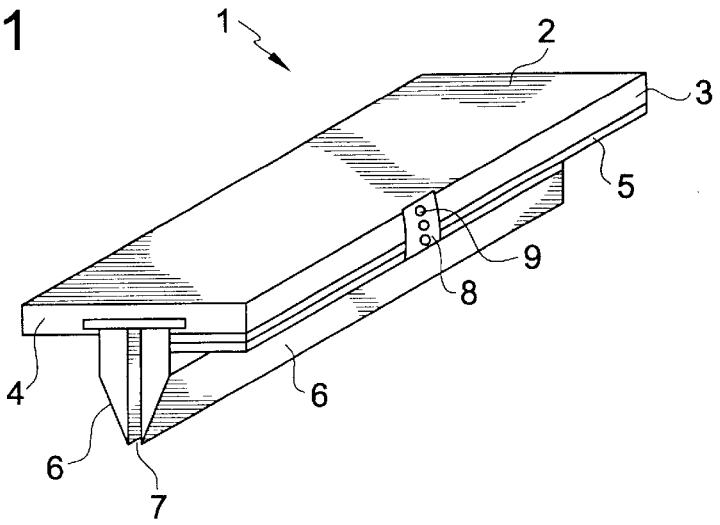
FIG. 1 is a perspective view of the present invention.

Referring now to the drawings in greater detail, FIG. 1 shows a perspective view of the present invention 1. The present invention is an accessory that can be used in conjunction with a knife to protect the blade, cushion a user's hand as he/she applies additional force to a knife when cutting with the knife, and to sharpen the blade of the knife. The accessory comprises a top surface 2, sides 3, and ends 4. At least one of the sides 3 has a slot 5 which runs the length of the side 3. In addition, a second slot 7 is positioned between the depending flanges 6 which depend from the top surface 2, sides 3, and ends 4.

Figure 2:
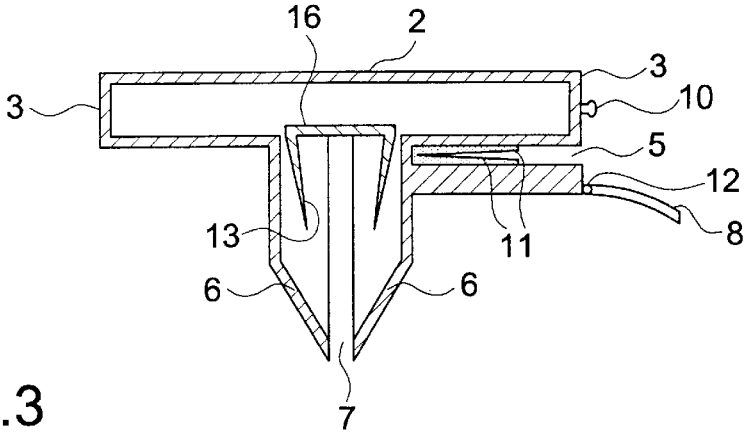
FIG. 2 is a cross-sectional view of the present invention.
Figure 3:
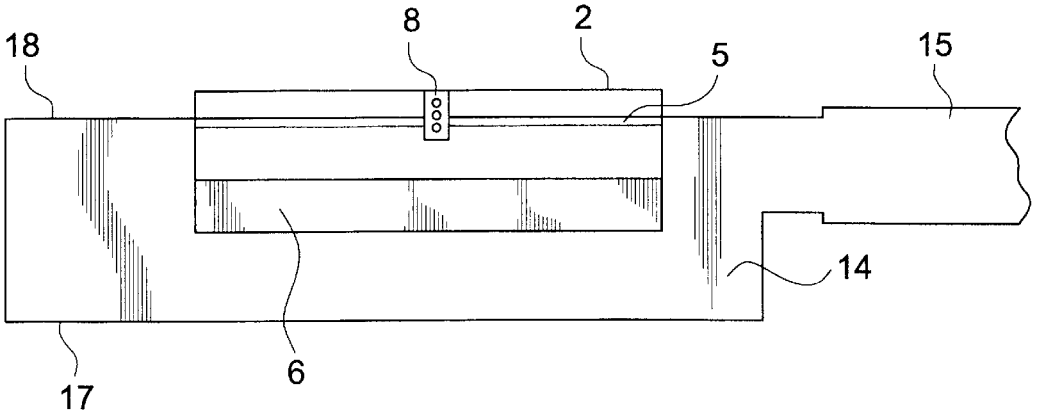
FIG. 3 is a side view of the present invention as applied to a knife.

The side 3 has a pivoting latch 8 which has at least one aperture 9 passing therethrough, for a purpose to be described in more detail below. Also, as shown in FIG. 2, the side 3 has a protrusion 10 which cooperates with the at least one aperture 10 in latch 8. The accessory 1 can be made from a variety of materials, however, plastic is the preferred material. Also, the accessory 1 can be made in a plurality of dimensions to fit various sizes of knives.

As shown in FIG. 2, a pair of sharpening stones 11 are affixed in the slot 5 in the side 3. The stones can be made from any conventional sharpening material and can be secured in the slot 5 in any conventional manner. It is preferred that the stones 11 run the entire length of the slot 5, however, the length of the stones 11 can be shorter than the slot 5 without departing from the scope of the invention.

Also shown in FIG. 2 is a catch 8 which is used to hold the sides of the slot 5 a specified distance apart so the stones 11 will not smash together and be damaged. The catch 8 can be pivoted on one side of the slot 5 by any conventional means such as, but not limited to, a hinge 12. The catch 8 has at least one aperture 9 (see FIG. 1) which will snap onto a headed projection 10. When the catch 8 is snapped onto the projection 10, the material of the catch 8 will prevent the sides of the slot 5 from moving toward each other. In this manner it will prevent the sharpening stones 11 from hitting each other and thereby being damaged.

In addition, as shown in FIG. 2, a substantially U-shaped piece of spring steel is embedded, or otherwise attached, in the body of the accessory 1. The piece of spring steel has a base 16 and depending fingers 13 which extend downwardly into the sides 6. The fingers 13 will keep the sides of the slot 7 tight against the blade 14 of a knife to securely fasten the accessory to the knife in order to protect the blade. In addition, the base 16 will prevent the blade of the knife from cutting through the top 2 of the accessory.

In order to use the accessory 1, a user would normally place the sharp edge 17 of the knife blade 14 in the slot 7 when the knife is not being used. The fingers 13 will keep the sides of the slot 7 tight against the blade 14 of the knife to securely fasten the accessory to the knife in order to protect the blade, and the base 16 will prevent the blade of the knife from cutting through the top 2 of the accessory.

When a user wants to use the knife, and/or the knife needs sharpening, the user would remove the knife from the slot 7, unlatch the latch 8 from the protrusion 10 and insert the blade 14 between the sharpening stones 11 and sharpen the blade in the conventional manner.

When a user wants to cut relatively hard items, such as whole chickens, carrots, potatoes or fish heads, the normal manner for cutting these items is to place the sharp edge 17 of the blade against the item and then to hit the blunt edge 18 of the blade with the user's hand in order to force the blade through the item. The blunt edge 18, however, is relatively small and will hurt the user's hand when used in this manner. In order to protect the user's hand and to impart greater force to the edge 18, the blunt edge 18 of the knife is inserted into the slot 7, which will leave the sharp edge 17 protruding from the accessory. Next, the latch 8 is secured to the projection 10 to prevent the sharpening stones from slamming together and being damaged. Then the user can hit or push against the top 2 of the accessory to force the knife through the item to be cut. In this manner, the sharpening stones 11 are protected, the edge 18 does not hurt the user's hand, and since the top 2 is much bigger than the edge 18 of the knife, greater force can be applied to cut the item.

Although the Knife Bun and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An accessory adapted to be used with a knife, said accessory comprising:

a body having a top, sides, ends and a bottom, at least one of said sides having a slot therein, a pair of flanges attached to said bottom, said flanges depending away from said bottom, said flanges having a groove therein, means within said flanges for holding said flanges in position with respect to each other, whereby a knife can be inserted within said groove in said flanges and securely held therein.

2. The accessory as claimed in claim 1, wherein said means within said flanges for holding said flanges in position comprises a substantially U-shaped spring, said spring having a base which is substantially parallel with said top and two fingers depending from said base.

3. The accessory as claimed in claim 2, wherein one of said two fingers extends within one of said flanges, and the of said two fingers extends within the of said flanges.

4. The accessory as claimed in claim 1, wherein said slot in at least one of said sides having a means for sharpening a knife secured therein.

5. The accessory as claimed in claim 4, wherein said slot in at least one of said sides having said means for sharpening a knife secured on one side of said slot, and a second means for sharpening a knife secured on the other side of said slot.

6. The accessory as claimed in claim 1, wherein said slot in at least one of said sides having a means for holding a first side of said slot in position with respect to a second side of said slot.

7. The accessory as claimed in claim 6, wherein said means for holding said first side of said slot in position with respect to said second side of said slot comprises a projection on said first side of said slot, and a catch on said second side of said slot, said catch engaging said projection and thereby holding said first side of said slot in position with respect to said second side of said slot.

8. The accessory as claimed in claim 7, wherein said catch is pivotally attached to said second side of said slot.

* * * * *